US007748152B2

(12) United States Patent
Reinold et al.

(10) Patent No.: US 7,748,152 B2
(45) Date of Patent: Jul. 6, 2010

(54) IMAGE DISPLAY APPARATUS AND METHOD FOR MAKING SAME

(75) Inventors: Juergen Reinold, Palatine, IL (US); Thomas M. McAuliffe, Evanston, IL (US); Rajat Shail, St. Joseph, MI (US)

(73) Assignee: Sentiam, Inc., Evanston, IL (US)

( * ) Notice: Subject to any disclaimer, the term of this patent is extended or adjusted under 35 U.S.C. 154(b) by 117 days.

(21) Appl. No.: 11/453,339

(22) Filed: Jun. 14, 2006

(65) Prior Publication Data

US 2007/0289182 A1 Dec. 20, 2007

(51) Int. Cl.
*A47G 1/06* (2006.01)

(52) U.S. Cl. ..... 40/773; 40/711

(58) Field of Classification Search ..... None
See application file for complete search history.

(56) References Cited

U.S. PATENT DOCUMENTS

| | | | | |
|---|---|---|---|---|
| 4,287,676 | A | 9/1981 | Weinhaus | |
| 4,676,686 | A | 6/1987 | Eisenloffel | |
| D292,872 | S | 11/1987 | Takahashi | |
| 5,269,083 | A * | 12/1993 | Vampatella et al. | 40/711 |
| 5,711,000 | A * | 1/1998 | Ploeg et al. | 455/423 |
| 5,711,100 | A | 1/1998 | Elmer | |
| 6,006,455 | A * | 12/1999 | Miller | 40/1.6 |
| 6,020,867 | A | 2/2000 | Shimada et al. | |
| 6,379,209 | B1 * | 4/2002 | Tucker | 445/24 |
| 6,742,295 | B2 * | 6/2004 | Gross | 40/711 |
| 2004/0057131 | A1 | 3/2004 | Hutzel et al. | |
| 2005/0028417 | A1 * | 2/2005 | Kim | 40/711 |
| 2006/0080878 | A1 * | 4/2006 | Kittrell | 40/780 |

OTHER PUBLICATIONS

International Searching Authority/US, PCT International Search Report, International Application No. PCT/US07/13695, Aug. 4, 2008.

* cited by examiner

*Primary Examiner*—Joanne Silbermann
(74) *Attorney, Agent, or Firm*—Beem Patent Law Firm

(57) ABSTRACT

An apparatus for the display of images comprises one or more graphical images, a rigid image support, at least one stand off, and a rigid display structure. A graphical image is affixed to the rigid image support typically through the use of adhesive. One end of the stand off is attached to the image support while the other end of the stand off is attached to the display structure. The attachment on at least one end of the stand off is releasable. The releasable attachment may be achieved with one or more magnets. The display structure contains features that allow attachment to a mounting surface and may contain features that enhance the display of the graphic image.

18 Claims, 2 Drawing Sheets

70A
75
74
77
110
100
44
112
60
63
12
10
100
110
73
76
70B
78
30B
30A
42
40
20
30E
62
71
72
30B
82
80
42
30B
30C
10
72
70B
60
76
20
12
63
12
10

30B
30A
100
60
110
70
12
44
10
100
110

40
20
42
62
30A
50B
70
92
92
30B
90
40
12
100
110
40
42
20
60
62
100
42
44
10
66
10
100
30B
110
92
50A
92

90
70

IMAGE DISPLAY APPARATUS AND METHOD FOR MAKING SAME

BACKGROUND OF THE INVENTION

1. Field of the Invention

The present invention is directed to a novel apparatus for mounting images for display and a method of making such an apparatus and of mounting images thereto.

2. Description of the Related Art

With the transition of digital photography from niche to mainstream use, amateur photographers are able to produce high-quality images in increasingly large formats. A significant segment of photographers want to display more of their photographs in larger formats, in their homes and offices. Today's dominant display method, framing with glass, is seriously deficient: it degrades the image and is expensive, especially in larger sizes. The current alternatives—framing dry mounted prints without glass or printing digital images on canvas and stretching them on a frame—are also expensive and not scalable to large volumes.

As the transition to digital photography approaches completion, consumers are developing an increasing appreciation for the high quality of images that digital cameras, combined with easy-to-use photo editing software, can deliver. They want to display more photographs, and in larger formats, in their homes and offices. They will also want to cost-effectively change the photographs they display.

The dominant method of displaying photographs today is to mat the image and use a frame with glass. Glass is used to protect the image (which has traditionally been relatively expensive and/or troublesome to replace if damaged), and to provide a rigid surface to keep the print flat. Today's framing techniques are rooted in approaches developed a century or more ago. Prints are now cheaper than glass and can be protected against harm from UV rays, but we are still using traditional methods that have significant negative effects. Glass degrades the image viewing experience because of reflections. If non-glare glass is used, reflections are diminished, but so are contrast and color saturation. This degradation becomes increasingly important as the appetite for and ability to produce high-quality photographic images increase.

The primary current alternative to the glass framing approach is to dry mount prints and frame them without glass. Dry mounting involves the use of a press and heat to adhere the print to a rigid material. Once the adhesive has cured, the mounted print is assembled into a frame. This method is labor-intensive, slow, and expensive. Its use is therefore limited.

The ultimate approach to addressing these emerging needs is the use of low-cost, very high-quality electronic displays. However, it may be years before such displays are available with the quality, form factors and battery life that would enable them to replace traditional frames displayed on walls, desks or shelves.

BRIEF SUMMARY OF THE INVENTION

A novel apparatus is provided for the display of graphical images including a rigid display structure with a first surface; a rigid image support structure with a first surface and an image surface; a releasable attachment between said first surface of said rigid display structure and said first surface of said rigid support structure; at least one stand-off between said rigid display structure and said rigid image support structure; and at least one image affixed to said image surface of said rigid support structure.

These and other features and advantages are evident from the following description of the present invention, with reference to the accompanying drawings.

DETAILED DESCRIPTION OF THE INVENTION

Figures 1, 2, 3:
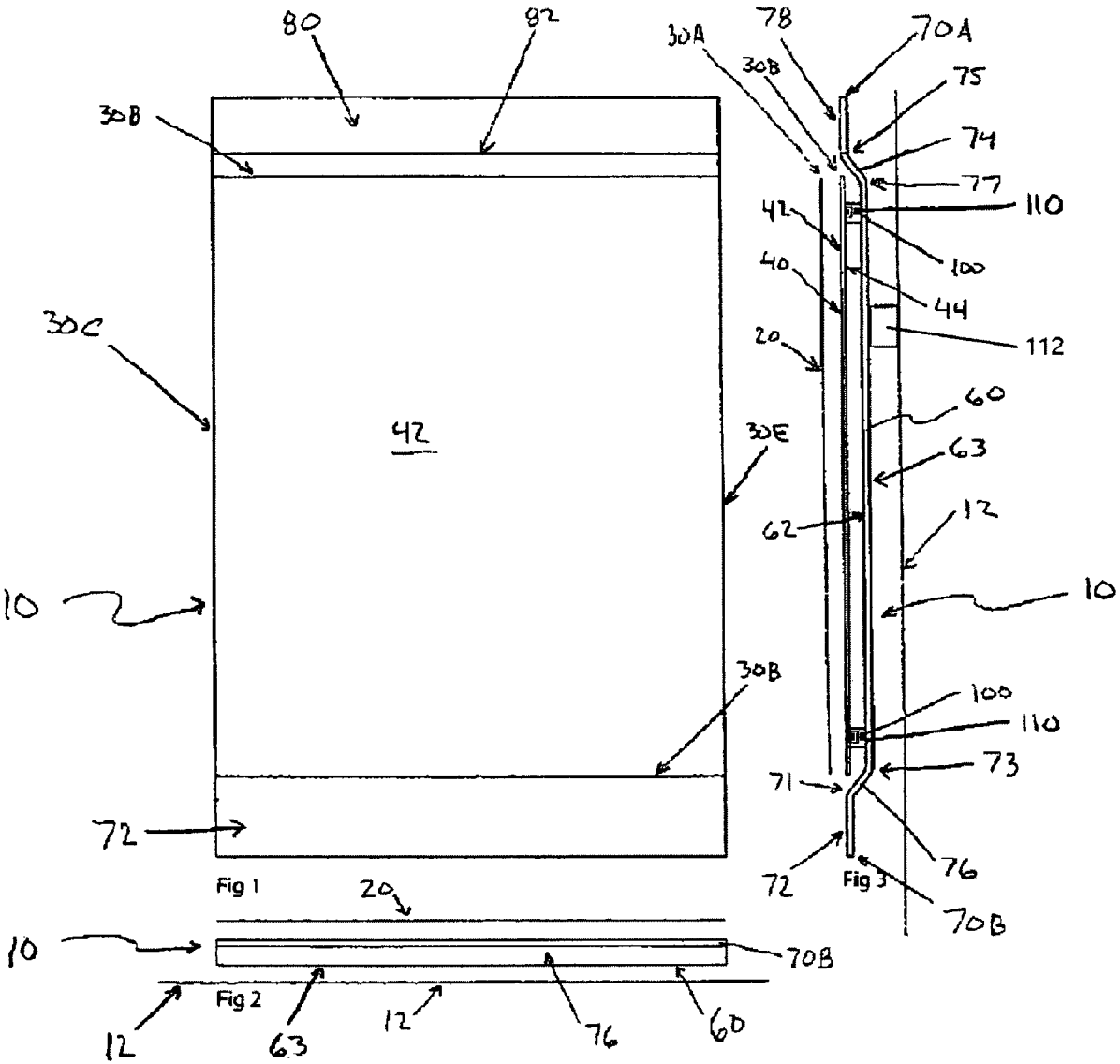
FIG. 1 is a plan view of an image display apparatus
FIG. 2 is a top view of the image display apparatus of FIG. 1
FIG. 3 is a side view of the image display apparatus shown in FIG. 1 that embodies a "gull wing" design for the display structure

Referring to FIGS. 1-6, a new concept for displaying graphic images without a picture frame or the traditional glass cover, i.e. a frameless, coverless display 10 for graphic images 20, is shown. Basic components of the display 10 include a plate, panel, sheet or rigid image support or rigid surface member 40 and a carrier, back member or rigid display structure or rigid support member 60. Most of the description herein describes a single image 20. In all cases, multiple images could be mounted instead of a single image 20. Similarly in the embodiments shown and described the image 20 is parallel to a wall or mounting surface 12; however, the image could be at any angle with relationship to mounting surface 12 or be non-planar, e.g. curved or irregular.

Referring to FIG. 3, a side view of the frameless, coverless display 10 is shown. A graphic image 20 is shown prior to being affixed to image surface 42 of rigid image support 40. Graphic image 20 could be a traditional silver-halide photo print, a modern high quality photo ink-jet print, mass print methods (like posters) or any other technique that results in a relatively flexible graphical image. Graphic image 20 can be affixed to rigid image support 40 in numerous ways. Affixing the graphic image 20 may be done through the use of a spray adhesive (such as 3M Photo Mount spray adhesive), or through the use of mass production techniques utilized in the field of circuit board assembly. These circuit board assembly techniques may include the placement of liquid or semi-liquid glue through stencil printing, print screening or knife coating. Dry mounting techniques are also suitable for affixing graphic image 20 to rigid image support 40. Any technique for the application of adhesive may be adapted to affix graphic image 20 to rigid image support 40. Graphic image 20 may also be generated or printed directly on rigid image support 40 through any process capable of applying a graphic image directly to rigid image support 40 or similar rigid media. In this adhesive free scenario graphic image 20 would not be created on an intermediate flexible print media that is subsequently affixed to rigid image support 40.

It may be desirable or advantageous to apply a protective coating to graphic image 20, especially if graphic image 20 is produced from a medium that uses water soluble, dye based inks. Any method that results in a protective coating that leaves the graphic image 20 visible is acceptable. One method of protection is to apply "Sureguard #931 Photographic Lacquer with UV Inhibitor—Matte Finish." Other finishes are available including glossy, luster, matte, or very matte. Other print methods such as silver-halide based photo printing are less susceptible to damage but may also receive and benefit from a protective coating.

In FIG. 3, rigid image support 40 has a first surface 44 and an image surface 42. Rigid image support 40 could be made from any rigid material. One embodiment of the rigid image support 40 makes use of acrylic. The use of light weight materials may result in a less expensive, more desirable product due to reduced shipping costs and ease of fabrication. Light weight materials may also be easier for the consumer to use. Any technique may be used to form rigid image support 40. Some techniques may include sawing, milling or laser cutting. Some techniques may require a subsequent polishing step. Some materials may be amenable to molding techniques. If plastic such as acrylic is used, bends may be formed using a local heating source such as a nichrome wire to selectively heat the plastic past its glass transition temperature. After passing the glass transition temperature, the plastic may be placed in a fixture to cool. This technique may introduces residual stresses. In order to eliminate the residual stresses, a further heating and cooling step may be employed. This further heating step may not require that the plastic is heated beyond the glass transition temperature. Other forming techniques may be used that may include drape forming, molding or heating and uniform cooling.

Figures 4, 5, 6:
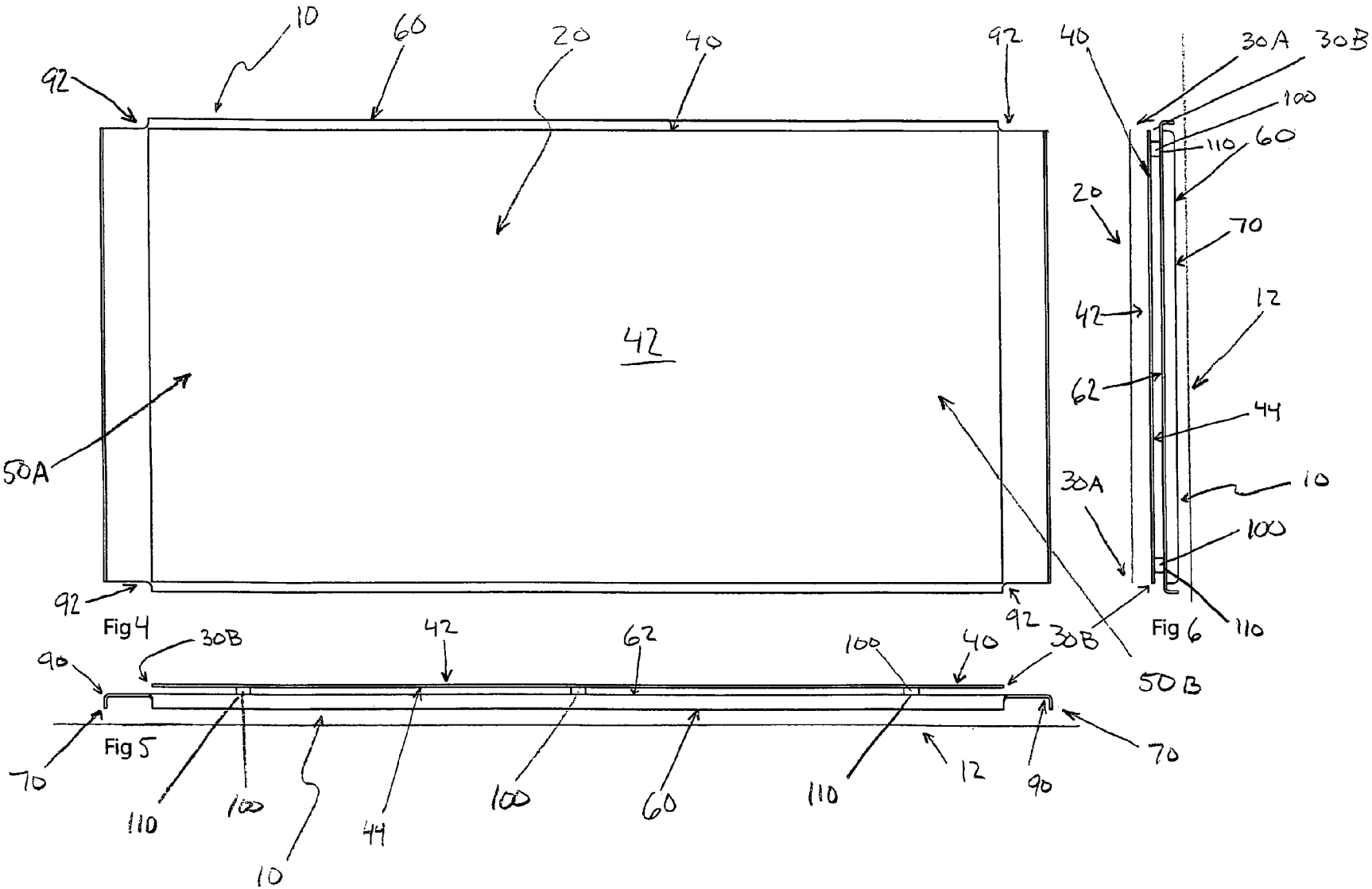
FIG. 4 is a plan view of another image display apparatus
FIG. 5 is a top view of the image display apparatus shown in FIG. 4
FIG. 6 is a side view of the image display apparatus shown in FIG. 4

In one embodiment of the invention, at least one edge 30A of graphic image 20 and one edge 30B rigid image support 40 are substantially coincident as shown in FIGS. 2 and 6. This may be achieved by precise placement of graphic image 20 onto rigid image support 40 using any placement technique. Techniques similar to those used in printed circuit board manufacture may be well suited for placing graphic image 20. These techniques may be similar to those used to align the layers of a printed circuit board during lamination or similar to those used to apply screened materials such as glue to the surface of a fully laminated circuit board. Another approach that results in edge 30A and edge 30B being approximately coincident includes processing techniques after graphic image 20 has been affixed to rigid image support 40. One post-affixing method involves the use of a laser to cut graphic image 20 and rigid image support 40 resulting in edge 30A coincident with edge 30B. If rigid image support 40 is a plastic such as acrylic, this laser cutting technique may provide a visually pleasing edge as the cutting process leaves a polished or finished cut in the plastic and blends or fuses edge 30A of graphic image 20 to edge 30B of rigid support image 40. In the embodiments shown all edges are coincident.

A further embodiment of rigid image support 40 includes one or more recesses or pockets (not shown) to locate graphic image 20. The pockets are about at least as deep as the thickness of the media used for graphic image 20. Exemplary depths include about 180 microns for certain Kodak photo paper and about 287 microns for HP Premium Plus Satin Photo Inkjet Paper. This approach allows for protection of the perimeter of graphic image 20 and may have a visually pleasing result.

In the illustrated embodiment, rigid image support 40 is shown flat; however, it is not necessary that rigid image support 40 be flat. In fact, it may be desirable or advantageous for rigid image support 40 to be shaped, such as curved. For images that are very wide but not very tall (like "Chicago Skyline") rigid image support 40 could be bent or curved on end 50A and end 50B towards rigid display structure 60. Bending end 50A and end 50B towards rigid display structure 60 would result in a substantially convex shape for image surface 42 and afford a person walking towards the picture (from either side) a better and earlier view of the picture. A further embodiment of the invention could include image surface 42 being shaped to form a concave surface to afford the viewer a panoramic view. The shapes of rigid image support 40 are only limited by the flexibility of the original graphical media used for graphic image 20, i.e. the limits of photo paper flexibility. Further, the shape of rigid image support 40 may take the profile of an object.

In FIG. 4, graphic image 20 and rigid image support 40 are shown rectangular. The shape of graphic image 20 and image support 40 are only limited by imagination but often will reflect shapes and sizes of the image shown in graphic image 20. The shape of graphic image 20 and rigid image support 40 may reflect sizes aspect ratios used in printing or photography. Exemplary ratios include 2:3, 3:4, 4:5, 5:6, and 1:1. Exemplary sizes in the United States include 8" by 10", 11" by 14", 12" by 18", 16" by 20", 16" by 24", 20" by 24", 20" by 30", 24" by 30", 24" by 36" and 30" by 40".

In FIG. 3, rigid display structure 60 is shown with a first surface 62 and a second surface 63. Rigid display structure 60 serves numerous purposes. The purposes of rigid display structure 60 include, among others, a mounting interface 112 between rigid image support 40 and mounting surface 12 and accent features to enhance the visual experience of graphic image 20. Rigid display structure 60 may be any shape or size. Rigid display structure 60 may be comprised of any material. Light weight materials such as acrylic or other plastics may be desirable. Any material resulting in a visually pleasing shape that is readily manufactured is a desirable material.

FIG. 3 shows rigid display structure 60 as a "gull wing" design. End 70A has bend 75 and bend 77 with the interstitial space between bend 75 and bend 77 forming web 74. End 70B has bend 71 and bend 73 with the interstitial space between bend 71 and bend 73 forming web 76. Bend 71 and bend 73 are each about 45 degrees and result in surface 72 that is substantially coplanar with rigid image support 40. Bend 75 and bend 77 are each about 45 degrees and result in surface 78 that is substantially coplanar with rigid image support 40. Bends 71, 73, 75, and 77 could be any angle so long as the pair of bends on a given end are about equal in magnitude and result in surfaces 72 and 78 which may be substantially coplanar or substantially parallel with rigid image support 40. End 70A is wrapped or surrounded with accent material 80 which may be a material such as metal or wood. Accent material 80 presents the viewer with what appears to be solid metal or wood which may result in a more visually pleasing appearance. Edge 82 delineates the end of accent material 80. Accent material 80 or a different accent material may also be applied to end 70B.

FIGS. 4, 5 and 6 show a further embodiment of display structure 60. In this embodiment at least one end 70 of rigid display structure 60 with bend 90 is bent away from rigid image support 40. Bend 90 may result in separation of first surface 62 of rigid display structure 60 from mounting surface 12 and may be used to change the angular relationship between first surface 62 of rigid display structure 60 and mounting surface 12. The use of two or more of bends 90 may give the impression of a thicker, more substantial rigid display structure 60 with minimal impact to overall weight or cost. With four bends 90 a box-like structure is formed. To form this box like structure one or more cut outs 92 may be required.

FIG. 5 shows stand off 100 which may form a permanent or releasable attachment 110 between rigid image support 40 and rigid display structure 60. Typical embodiments of stand off 100 that result in a releasable attachment 110 include magnetic attachment but could also include any other fastening technique such as hook and loop fabric (Velcro™), snap fits, suction cups, or pins with detent mechanisms. A further embodiment of stand off 100 may include at least one hinge mechanism (not shown) that would allow for rigid image support 40 to rotate outward and away from rigid display structure 60 and gain access to first surface 44 of rigid image support 40, first surface 62 of rigid display structure 60 or one or more additional image support structures (not shown). The use of standard sizes and attachment locations for stand off 100 could allow multiple configurations, shapes or sizes of rigid image support 40 to be attached to one or more versions of rigid display structure 60. Further, at least one embodiment of stand off 100 provides a self guiding attachment mechanism that automatically aligns the image support 40 with rigid display structure 60.

Selection of a releasable attachment 110 for stand off 100 may allow rigid image support 40 to be easily detached from rigid display structure 60 but still be strong enough to avoid or eliminate rigid image support 40 from coming off inadvertently (bump, shearing off, etc.). One embodiment of stand off 100 that effectuates this releasable attachment 110 is for stand off 100 to be round with embedded round magnets attached to first surface 44 of rigid image support 40 and larger round holes (or stand-offs) on rigid display structure 60 with embedded magnets or ferrous metal to receive stand off 100 with some overlap. Using magnets creates a "self guiding" releasable attachment 110 that automatically aligns rigid image support 40 to rigid display structure 60. The number of magnets and magnet size may be chosen so that rigid image support 40 is safely attached to rigid display structure 60 so as to prevent accidental falling off of rigid display structure 60. If rigid image support 40 is pulled off of rigid display structure 60, rigid display structure 60 should safely stay attached to mounting surface 12.

Rigid display structure 60 may be attached to mounting surface 12 by any temporary or permanent method. Exemplary attachment methods between rigid display structure 60 and mounting surface 12 may include hook, nail, or screw mounting or block and ledge mounting. A floating mount may be used in which the rigid display structure 60 is held some distance away from the mounting surface 12, an exemplary distance being about 0.75 to 1.5 inches. One embodiment of the distance holders would be in the center of rigid display structure 60 so the distance holders are minimally visible from the sides, top, and bottom.

A further possible mounting mechanism between rigid display structure 60 and mounting surface 12 uses strings or wire that hang from a rail and terminate behind rigid display structure 60 (e.g., no string showing below the bottom of rigid display structure 60) or the strings may be attached to the floor and ceiling with clamp-like devices affixing rigid display structure 60 to the strings with the strings visible above and below rigid display structure 60. String could be attached with connectors to the mounting surface 12 (above, below, or behind display structure). Strings may or may not be visible.

Mounting between rigid display structure 60 and mounting surface 12 may also be achieved with magnets attached to both display structure 60 and mounting surface 12 or magnets may have adapters to interface to other hardware devices such as nails or hooks.

A further embodiment of mounting hardware includes features that aid in placement and alignment. One exemplary piece of hardware includes an indicator (like bubble on the top) that allows the installer to rotate it to a known position. A further embodiment of the mounting hardware includes a laser diode that creates a visual indicator to aid placement on mounting surface 12. One embodiment of visual indicator may take the form of a dot or of two intersecting lines left and/or right of or above and/or below the mounting hardware on mounting surface 12 to indicate where the other mounting hardware may be placed. This light indicator may assure proper distance between the two pieces of mounting hardware. This feature may assure the mounting hardware is properly aligned upon installation.

As part of the visual experience of this image display apparatus 10, lighting effects may be desirable. Exemplary lighting may include uniform lighting of graphic image 20, edge lighting or "edge glow" from one or more edge 30B of rigid image support 40 or edge 30C of rigid display structure 60, or lighting that results in an "ambient glow" on and around mounting surface 12. With an edge glow one or more edge 30C of the rigid display structure 60 or edge 30B of rigid image support 40 glows. Spill-over of light to mounting surface 12 may be minimized. With an ambient glow an aura of light is generated around rigid display structure 60 and on mounting surface 12.

An exemplary way in which the edge glow or ambient glow may be achieved is through the use of a light conducting material such as acrylic to form rigid image support 40 and/or rigid display structure 60. Use of a light conducting material may transport the light from the source to where it becomes effective. An edge glow or ambient glow may be achieved by properly forming the light conductive material.

Color of light used in the above embodiments could be tunable to create warmer or harsher moods depending on the picture displayed. All of the above mentioned lighting effects could be achieved with one or more Light Emitting Diode ("LED") based light sources. The LEDs could generate white light, or a fixed color such as red, yellow, green or blue. A Red-Green-Blue LED could be tuned to generate any color combination from a combination of red, green, and blue.

The color of the emitted light could be constant and fixed. The color of the emitted light could be constant but variable (e.g., Red-Green-Blue LED used with Red-Green-Blue component that is tunable). The color of the emitted light could change automatically based on some pattern (random, time of day, level of light). Intensity of light could be fixed, variable, selectable, or automatically adjusting to the time of day or other patterns.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

What is claimed is:

1. A coverless and frameless apparatus for the display of images comprising:

a rigid display structure with a first surface;

a rigid image support structure with a first surface and an image surface;

a plurality of stand-offs between said rigid display structure and said rigid image support structure;

a plurality of first magnetic releasable attachments entirely between said first surface of said rigid display structure and said first surface of said rigid support structure, wherein each of said first magnetic releasable attachments is coupled to said rigid image support structure;

a plurality of second magnetic releasable attachments entirely between said first surface of said rigid display structure and said first surface of said rigid support structure, wherein each of said second magnetic releasable attachments is coupled to said first surface of said rigid display structure, wherein each of said stand-offs overlap a portion of both of a respective first magnetic releasable attachment and a respective second magnetic releasable attachment to facilitate alignment of said rigid display structure and said rigid image support structure and to prevent shearing off of said rigid image support structure from said rigid display structure; and at least one printed image affixed to said image surface of said rigid support structure.

2. A coverless and frameless apparatus for the display of images according to claim 1, wherein said plurality of first releasable attachments contains at least one magnet.

3. A coverless and frameless apparatus for the display of images according to claim 1, wherein at least one edge of said at least one image is substantially coincident with at least one edge of said rigid image support structure.

4. A coverless and frameless apparatus for the display of images according to claim 1, wherein said rigid display structure contains acrylic.

5. A coverless and frameless apparatus for the display of images according to claim 1, wherein said rigid image support structure contains acrylic.

6. A coverless and frameless apparatus for the display of images according to claim 1, wherein said rigid display structure has a second surface; and at least one device for attachment to a wall is attached to said second surface of said rigid display structure.

7. A coverless and frameless apparatus for the display of images according to claim 1, wherein said first surface of said rigid image support structure is substantially parallel to said image surface of said rigid image support structure.

8. A coverless and frameless apparatus for the display of images according to claim 1, wherein said rigid display structure has a second surface; and said first surface of said rigid display structure is substantially parallel to said second surface of said rigid display structure.

9. A coverless and frameless apparatus for the display of images according to claim 1, wherein said rigid display structure has at least one bend.

10. A coverless and frameless apparatus for the display of images according to claim 9, wherein said rigid display structure has at least one surface substantially coplanar with said rigid image support structure.

11. A coverless and frameless apparatus for the display of images according to claim 9, wherein said at least one image is a photograph.

12. A coverless and frameless apparatus for the display of images according to claim 9, wherein said at least one image is an image printed on paper.

13. A coverless and frameless apparatus for the display of images according to claim 1, wherein said at least one image is substantially flush with said image surface.

14. A coverless apparatus for the display of images comprising:

a rigid surface member;

said rigid surface member contacting a first end of at least one stand off;

said at least one stand off having a second end contacting a rigid support member;

at least one end of said at least one stand off having a releasable attachment mechanism having at least one first magnet substantially embedded within said at least one stand off;

at least one second magnet coupled to said rigid support member, wherein said first and second magnets facilitate aligning said rigid surface member and said rigid support member in a predetermined position;

wherein said at least one stand off overlaps a portion of both said at least one first magnet and said at least one second magnet to prevent shearing off of said rigid surface member from said rigid support member;

said rigid support member having at least three substantially planar surfaces;

at least one of said at least three substantially planar surfaces being substantially co-planar with said rigid surface member;

at least one web interconnecting said at least three substantially planar surfaces; and at least one mounting surface, wherein said rigid support member is coupled to said at least one mounting surface.

15. A coverless apparatus for the display of images comprising:

a rigid surface member;

said rigid surface member contacting a first end of at least one stand off;

said at least one stand off having a second end contacting a rigid support member;

at least one end of said at least one stand off having a releasable attachment mechanism having at least one first magnet substantially embedded within said at least one stand off;

at least one second magnet coupled to said rigid support member, wherein said first and second magnets facilitate aligning said rigid surface member and said rigid support member in a predetermined position;

wherein said at least one stand off overlaps a portion of both said at least one first magnet and said at least one second magnet to prevent shearing off of said rigid surface member from said rigid support member;

said rigid support member having at least two substantially planar surfaces;

at least one of said at least two substantially planar surfaces being oriented at an angle with at least one of said at least two substantially planar surfaces;

at least one web between said at least two substantially planar surfaces; and at least one mounting surface, wherein said rigid support member is coupled to said at least one mounting surface.

16. A coverless apparatus for the display of images according to claim 15, wherein said at least one magnet is coupled proximate said first end of said at least one standoff.

17. A coverless apparatus for the display of images according to claim 16, wherein said second end is configured to receive at least one second magnet to facilitate magnetically coupling said at least one first magnet to said at least one second magnet and to facilitate coupling said rigid surface member to said rigid support member.

18. A coverless apparatus for the display of images according to claim 17, wherein said first end and said second end are configured to facilitate automatically aligning said rigid surface member and said rigid support member.

* * * * *